US005175225A

United States Patent [19]

Ruhe, Jr.

[11] Patent Number: 5,175,225

[45] Date of Patent: Dec. 29, 1992

[54] PROCESS FOR PREPARING POLYMERIC DISPERSANTS HAVING ALTERNATING POLYALKYLENE AND SUCCINIC GROUPS

[75] Inventor: William R. Ruhe, Jr., Benicia, Calif.

[73] Assignee: Chevron Research and Technology Company, San Francisco, Calif.

[21] Appl. No.: 414,876

[22] Filed: Sep. 29, 1989

[51] Int. Cl.[5] ..... C08F 222/04; C08F 222/02; C08F 214/14; C08F 218/14

[52] U.S. Cl. ..... 526/272; 526/318.25; 526/291; 526/329

[58] Field of Search ..... 526/272, 203, 291, 329

[56] References Cited

U.S. PATENT DOCUMENTS

| | | | |
|---|---|---|---|
| Re. 28,475 | 7/1975 | Blecke et al. | 526/203 |
| 2,542,542 | 2/1951 | Lippincott et al. | 526/272 |
| 4,152,499 | 5/1979 | Boerzel et al. | 526/52.4 |
| 4,605,808 | 8/1986 | Samson | 585/525 |
| 5,112,507 | 5/1992 | Harrison | 252/51.5 A |

FOREIGN PATENT DOCUMENTS 63-270671 11/1988 Japan .

*Primary Examiner*—Joseph L. Schofer
*Assistant Examiner*—Wu C. Cheng
*Attorney, Agent, or Firm*—C. J. Caroli; S. R. LaPaglia

[57] ABSTRACT

A process for preparing an oligomeric copolymer of an unsaturated acidic reactant and a high molecular weight olefin having a sufficient number of carbon atoms such that the resulting copolymer is soluble in lubricating oil and wherein at least 20 weight percent of the total olefin comprises an alkylvinylidene isomer, which process comprises reacting the high molecular weight olefin with the unsaturated acidic reactant in the presence of a solvent which comprises the reaction product of an unsaturated acidic reactant and a high molecular weight olefin.

12 Claims, No Drawings

PROCESS FOR PREPARING POLYMERIC DISPERSANTS HAVING ALTERNATING POLYALKYLENE AND SUCCINIC GROUPS

BACKGROUND OF THE INVENTION

The present invention relates to a process for preparing compositions which are useful as intermediates for dispersants used in lubricating oil compositions or as dispersants themselves. In addition, some of the compositions prepared by the present process are useful in the preparation of high molecular weight dispersants which have superior dispersant properties for dispersing sludge and varnish and superior Viton Seal compatibility. Such high molecular weight dispersants also advantageously impart fluidity modifying properties to lubricating oil compositions which are sufficient to allow elimination of some proportion of viscosity index improver from multigrade lubricating oil compositions which contain these dispersants.

It is known in the art that alkenyl-substituted succinic anhydrides have been used as dispersants. Such alkenyl-substituted succinic anhydrides have been prepared by two different processes, a thermal process (see, e.g., U.S. Pat. No. 3,361,673) and a chlorination process (see, e.g., U.S. Pat. No. 3,172,892). The polyisobutenyl succinic anhydride ("PIBSA") produced by the thermal process has been characterized as a monomer containing a double bond in the product. Although the exact structure of chlorination PIBSA has not been definitively determined, the chlorination process PIBSA materials have been characterized as monomers containing either a double bond, a ring other than a succinic anhydride ring and/or chlorine in the product. [See J. Weill and B Sillion, "Reaction of Chlorinated Polyisobutene with Maleic Anhydride:Mechanism Catalysis by Dichloromaleic Anhydride", Revue de l'Institut Français du Petrole, Vol. 40, No. 1, pp. 77–89 (January-February, 1985).] Such compositions include one-to-one monomeric adducts (see, e.g., U.S. Pat. Nos. 3,219,666; 3,381,022) as well as adducts having polyalkenyl-derived substituents adducted with at least 1.3 succinic groups per polyalkenyl-derived substituent (see, e.g., U.S. Pat. No. 4,234,435).

In addition, copolymers of maleic anhydrides and some aliphatic alpha-olefins have been prepared. The polymers so produced were useful for a variety of purposes including dispersants for pigments and intermediates in the preparation of polyesters by their reaction with polyols or polyepoxides. However, olefins having more than about 30 carbon atoms were found to be relatively unreactive. (See, e.g., U.S. Pat. Nos. 3,461,108; 3,560,455; 3,560,456; 3,560,457; 3,580,893; 3,706,704; 3,729,450; and 3,729,451).

Commonly assigned copending U.S. patent application Ser. No. 251,613, to James J. Harrison, filed Sep. 29, 1988, entitled "Novel Polymeric Dispersants Having Alternating Polyalkylene and Succnic Groups" discloses copolymers prepared by reacting an unsaturated acidic reactant, such as maleic anhydride, with a high molecular weight olefin, such as polyisobutene, in the presence of a free radical initiator, wherein at least about 20 percent of the total high molecular weight olefin comprises an alkylvinylidene isomer and wherein the high molecular weight olefin has a sufficient number of carbon atoms such that the resultng coolymer is soluble n lubricating oil. In U.S. Ser. No. 251,613, it is also taught that the reaction may be conducted neat or in the presence of a solvent in which the reactants and free radical initiator are soluble. Suitable solvents disclosed in U.S. Ser. No. 251,613 include liquid saturated or aromatic hydrocarbons having from 6 to 20 carbon atoms, ketones having from 3 to 5 carbon atoms and liquid saturated aliphatic dihalogenated hydrocarbons havng from 1 to 5 carbon atoms. Examples of solvents taught in U.S. Ser. No. 251,613 are acetone, tetrahydrofuran, chloroform, methylene chloride, dichloroethane, toluene, dioxane, chlorobenzene and xylene.

The use of halogenated hydrocarbons as a solvent in the reaction of unsaturated acidic reactants, such as maleic anhydride, and high molecular weight olefins of the type described in U.S. Ser. No. 251,613 has a number of disadvantages. Such solvents are expensive, they are environmentally undesirable and they impede recycling of lubricating oils because of the residual halogen content.

In the above-described reaction, the solvent is used primarily to solubilize the unsaturated acidic reactant, but also serves to reduce the viscosity of the reaction mixture. Unsaturated acidic reactants such as maleic anhydride are not very soluble in high molecular weight olefins at typical reaction temperatures of 50° C. to 210° C. When the unsaturated acidic reactant is maleic anhydride, it has been found that if the maleic anhydride forms a separate phase due to poor solubility, not only is the reaction rate negatively affected, but an undesirable resin or tar-like substance is formed which is believed to be polymaleic anhydride. Consequently, it would be highly advantageous to provide a process which avoids this condition, without having to resort to a halogenated hydrocarbon solvent.

SUMMARY OF THE INVENTION

The present invention is directed to a process for preparing an oligomeric copolymer of an unsaturated acidic reactant and a high molecular weight olefin having a sufficient number of carbon atoms such that the resulting copolymer is soluble in lubricating oil and wherein at least 20 weight percent of the total olefin comprises an alkylvinylidene isomer, which process comprises reacting the high molecular weight olefin with the unsaturated acidic reactant in the presence of a free radical initiator and a solvent which comprises the reaction product of an unsaturated acidic reactant and a high molecular weight olefin. Preferably, the solvent comprises (a) an oligomeric copolymer of an unsaturated acidic reactant and a high molecular weight olefin; or (b) a monomeric adduct of an unsaturated acidic reactant and a high molecular weight olefin in at least a one to one mole ratio of acidic reactant to olefin; or a mixture thereof.

The copolymers produced by the present process have alternating succinic and polyalkylene groups. Suitable olefins for use in preparing these copolymers include those having about 32 carbon atoms or more, preferably having about 52 carbon atoms or more. Those preferred high molecular weight olefins include polyisobutenes. Especially preferred olefins for use in preparing the copolymer products are polyisobutenes having average molecular weights of from about 500 to about 5000 and in which the alkylvinylidene isomer comprises at least 50 percent of the total olefin.

The copolymers prepared by the process of the invention are useful as dispersants themselves and also as intermediates in the preparation of other dispersant additives having improved dispersancy and/or detergency properties when employed in a lubricating oil. These copolymers are also advantageous because they do not contain double bonds, rings other than succinic anhydride rings, or chlorine (in contrast to thermal and chlorination PIBSAs) and as such have improved stability, as well as improved environmental properties due to the absence of chlorine.

The copolymers produced by the instant process can also be used to form polysuccinimides which are prepared by reacting the copolymer with a polyamine to give a polysuccinimide. Such polysuccinimides include mono-polysuccinimides (where a polyamine component reacts with one succinic group); bispolysuccinimides (where a polyamine component reacts with a succinic group from each of two copolymer molecules, thus effectively cross-linking the copolymer molecules); and higher polysuccinimides (where a polyamine component reacts with a succinic group from each of greater than 2 copolymer molecules). These polysuccinimides are useful as dispersants and/or detergents in fuels and oils. In addition, these polysuccinimides have advantageous viscosity modifying properties, and may provide a viscosity index credit ("V.I. Credit") when used in lubricating oils, which may permit elimination of some portion of viscosity index improver ("V.I. Improver") from multigrade lubricating oils containing the same.

In addition, such polysuccinimides can form a ladder polymeric structure or a cross-linked polymeric structure. These structures are advantageous because it is believed such structures are more stable and resistant to hydrolytic degradation and also to degradation by shear stress.

Moreover, the copolymers prepared by the present process can be employed to make modified polysuccinimides wherein one or more of the nitrogens of the polyamine component is substituted with a hydrocarbyl oxycarbonyl, a hydroxyhydrocarbyl oxycarbonyl or a hydroxy poly(oxyalkylene)-oxycarbonyl. These modified polysuccinimides are improved dispersants and/or detergents for use in fuels or oils.

Accordingly, the copolymers made by the present process are useful in providing a lubricating oil composition comprising a major amount of an oil of lubricating viscosity and an amount of a copolymer, polysuccinimide or modified succinimide additive sufficient to provide dispersancy and/or detergency. These additives may also be formulated in lubricating oil concentrates which comprise from about 90 to about 50 weight percent of an oil of lubricating viscosity and from about 10 to about 50 weight percent of the additive.

Furthermore, the copolymers formed by the present process can be used to provide a fuel composition comprising a major portion of a fuel boiling in a gasoline or diesel range and an amount of copolymer, polysuccinimide or modified succinimide additives sufficient to provide dispersancy and/or detergency. These additives can also be used to make fuel concentrates comprising an inert stable oleophilic organic solvent boiling in the range of about 150° F to about 400° F and from about 5 to about 50 weight percent of such additive.

DEFINITIONS

As used herein, the following terms have the following meanings unless expressly stated to the contrary. The term "unsaturated acidic reactants" refers to maleic or fumaric reactants of the general formula:

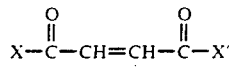

(II)

wherein X and X' are the same or different, provided that at least one of X and X' is a group that is capable of reacting to esterify alcohols, form amides or amine salts with ammonia or amines, form metal salts with reactive metals or basically reacting metal compounds and otherwise function as acylating agents. Typically, X and/or X' is —OH, —O—hydrocarbyl, —$OM^+$ where $M^+$ represents one equivalent of a metal, ammonium or amine cation, —$NH_2$, —Cl, —Br, and taken together X and X' can be —O— so as to form an anhydride. Preferably X and X' are such that both carboxylic functions can enter into acylation reactions. Maleic anhydride is a preferred unsaturated acidic reactant. Other suitable unsaturated acidic reactants include electron-deficient olefins such as monophenyl maleic anhydride; monomethyl, dimethyl, monochloro, monobromo, monofluoro, dichloro and difluoro maleic anhydride; N-phenyl maleimide rnd other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile.

The term "alkylvinylidene" or "alkylvinylidene isomer" refers to high molecular weight olefins and polyalkylene components having the following vinylidene structure

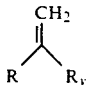

(III)

wherein R is alkyl or substituted alkyl of sufficient chain length to give the resulting molecule solubility in lubricating oils and fuels, thus R generally has at least about 30 carbon atoms, preferably at least about 50 carbon atoms and Rv is lower alkyl of about 1 to about 6 carbon atoms.

The term "soluble in lubricating oil" refers to the ability of a material to dissolve in aliphatic and aromatic hydrocarbons such as lubricating oils or fuels in essentially all proportions.

The term "high molecular weight olefins" refers to olefins (including polymerized olefins having a residual unsaturation) of sufficient molecular weight and chain length to lend solubility in lubricating oil to their reaction products. Typically olefins having about 32 carbons or greater (preferably olefins having about 52 carbons or more) suffice.

The term "high molecular weight polyalkyl" refers to polyalkyl groups of sufficient molecular weight and hydrocarbyl chain length that the products prepared having such groups are soluble in lubricating oil. Typically these high molecular weight polyalkyl groups have at least about 30 carbon atoms, preferably at least about 50 carbon atoms. These high molecular weight polyalkyl groups may be derived from high molecular weight olefins.

The term "PIBSA" is an abbreviation for polyisobutenyl succinic anhydride.

The term "polyPIBSA" refers to a class of copolymers within the scope of the present invention which are copolymers of polyisobutene and an unsaturated acidic reactant which have alternating succinic groups and polyisobutyl groups. PolyPIBSA has the general formula

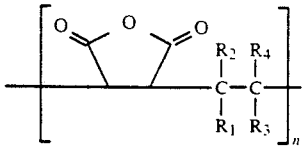

wherein n is one or greater; $R_1$, $R_2$, $R_3$ and $R_4$ are selected from hydrogen, methyl and polyisobutyl having at least about 30 carbon atoms (preferably at least about 50 carbon atoms) wherein either $R_1$ and $R_2$ are hydrogen and one of $R_3$ and $R_4$ is methyl and the other is polyisobutyl, or $R_3$ and $R_4$ are hydrogen and one of $R_1$ and $R_2$ is methyl and the other is polyisobutyl.

The term "PIBSA number" refers to the anhydride (succinic group) content of polyPIBSA on a 100% actives basis. The PIBSA number is calculated by dividing the saponification number by the percent polyPIBSA in the product. The units are mg KOH per gram sample.

The term "succinic group" refers to a group having the formula

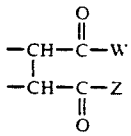

(IV)

wherein W and Z are independently selected from the group consisting of —OH, —Cl, —O— lower alkyl or taken together are —O— to form a succinic anhydride group. The term "—O— lower alkyl" is meant to include alkoxy of 1 to 6 carbon atoms.

The term "degree of polymerization" expresses the length of a linear polymer an refers to the number of repeating (monomeric) units in the chain. The average molecular weight of a polymer is the product of the degree of polymerization and the average molecular weight of the repeating unit (monomer). Accordingly, the average degree of polymerization is calculated by dividing the average molecular weight of the polymer by the average molecular weight of the repeating unit.

The term "polysuccinimide" refers to the reaction product of a copolymer made by the present process with polyamine.

DETAILED DESCRIPTION OF THE INVENTION

A. Copolymer

The copolymers made by the present process are prepared by reacting a high molecular weight olefin wherein at least about 20% of the total olefin composition comprises the alkylvinylidene isomer and an unsaturated acidic reactant in the presence of a free radical initiator and a solvent comprising the reaction product of an unsaturated acidic reactant and a high molecular weight olefin. Preferably, the solvent comprises (a) an oligomeric copolymer of an unsaturated acidic reactant and a high molecular weight olefin or (b) a monomeric adduct of an unsaturated acidic reactant and a high molecular weight olefin in at least a one to one mole ratio of acidic reactant to olefin; or a mixture thereof.

Suitable high molecular weight olefins have a sufficient number of carbon atoms so that the resulting copolymer is soluble in lubricating oil and thus have on the order of about 32 carbon atoms or more. Preferred high molecular weight olefins are polyisobutenes and polypropylenes. Especially preferred are polyisobutenes, particularly preferred are those having a molecular weight of about 500 to about 5000, more preferably about 900 to about 2500. Preferred unsaturated acidic reactants include maleic anhydride.

Since the high molecular weight olefins used in the process of the present invention are generally mixtures of individual molecules of different molecular weights, individual copolymer molecules resulting will generally contain a mixture of high molecular weight polyalkyl groups of varying molecular weight. Also, mixtures of copolymer molecules having different degrees of polymerization will be produced.

The copolymers made by the process of the present invention have an average degree of polymerization of 1 or greater, preferably from about 1.1 to about 20, and more preferably from about 1.5 to about 10.

In accordance with the process of the present invention, the desired copolymer products are prepared by reacting a "reactive" high molecular weight olefin in which a high proportion of unsaturation, at least about 20% , is in the alkylvinylidene configuration, e.g.,

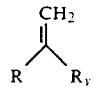

wherein R and $R_Y$ are as previously defined in conjunction with Formula III, with an unsaturated acidic reactant in the presence of a free radical initiator and an oligomeric or monomeric solvent as described above. The product copolymer has alternating polyalkylene and succinic groups and has an average degree of polymerization of 1 or greater.

The copolymers prepared by the instant process have the general formula:

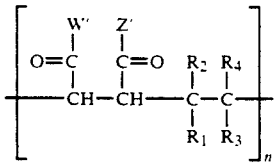

wherein W' and Z' are independently selected from the group consisting of —OH, —O— lower alkyl or taken together are —O— to form a succinic anhydride group, n is one or greater; and $R_1$, $R_2$, $R_3$ and $R_4$ are selected from hydrogen, lower alkyl of 1 to 6 carbon atoms, and high molecular weight polyalkyl wherein either $R_1$ and $R_2$ are hydrogen and one of $R_3$ and $R_4$ is lower alkyl and the other is high molecular weight polyalkyl, or $R_3$ and $R_4$ are hydrogen and one of $R_1$ and $R_2$ is lower alkyl and the other is high molecular weight polyalkyl.

In a preferred embodiment, when maleic anhydride is used as the unsaturated acidic reactant, the reaction produces copolymers predominately of the following formula:

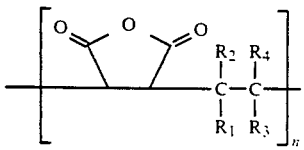

(IA)

wherein n is about 1 to about 100, preferably about 2 to about 20, more preferably 2 to 10, and $R_1$, $R_2$, $R_3$ and $R_4$ are selected from hydrogen, lower alkyl of about 1 to 6 carbon atoms and higher molecular weight polyalkyl, wherein either $R_1$ and $R_2$ are hydrogen and one of $R_3$ and $R_4$ is lower alkyl and the other is high molecular weight polyalkyl or $R_3$ and $R_4$ are hydrogen and one of $R_1$ and $R_2$ is lower alkyl and the other is high molecular weight polyalkyl.

Preferably, the high molecular weight polyalkyl group has at least about 30 carbon atoms, preferably at least about 50 carbon atoms. Preferred high molecular weight polyalkyl groups include polyisobutyl groups. Preferred polyisobutyl groups include those having average molecular weights of about 500 to about 5000, more preferably from about 900 to about 2500. Preferred lower alkyl groups include methyl and ethyl; especially preferred lower alkyl groups include methyl.

Generally, such copolymers contain an initiator group, I, and a terminator group, T, as a result of the reaction with the free radical initiator used in the polymerization reaction. In such a case, the initiator and terminator groups may be

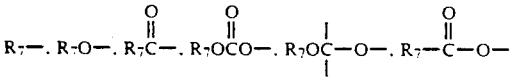

where $R_7$ is hydrogen, alkyl, aryl, alkaryl, cycloalkyl, alkoxy, cycloalkoxy, acyl, alkenyl, cycloalkenyl, alkynyl; or alkyl, aryl or alkaryl optionally substituted with 1 to 4 substituents independently selected from nitrile, keto, halogen, nitro, alkyl, aryl, and the like. Alternatively, the initiator group and/or terminator group may be derived from the reaction product of the initiator with another material, such as solvent.

The copolymers prepared by the present process differ from the PIBSAs prepared by the thermal process in that the thermal process products contain a double bond and a singly substituted succinic anhydride group, that is, a monomeric one to one adduct. The copolymers prepared by the present process differ from the PIBSAs prepared by the chlorination process, since those products contain a double bond, a ring other than a succinic anhydride ring, or one or more chlorine atoms.

The copolymers prepared by the present process contain no double bonds, rings other than succinic anhydride rings, or chlorine atoms. In addition, the succinic anhydride groups are doubly substituted (i.e., have two substituents, one of which may be hydrogen) at the 2- and 3-positions, that is:

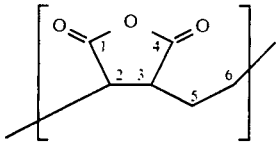

A(1) High Molecular Weight Polyalkylene Group

The high molecular weight polyalkyl group is derived from a high molecular weight olefin. The high molecular weight olefins used in the preparation of the instant copolymers are of sufficiently long chain length so that the resulting composition is soluble in and compatible with mineral oils, fuels and the like; and the alkylvinylidene isomer of the high molecular weight olefin comprises at least about 20% of the total olefin composition.

Such high molecular weight olefins are generally mixtures of molecules having different molecular weights and can have at least one branch per 6 carbon atoms along the chain, preferably at least one branch per 4 carbon atoms along the chain, and particularly preferred that there be about one branch per 2 carbon atoms along the chain. These branched chain olefins may conveniently comprise polyalkenes prepared by the polymerization of olefins of from 3 to 6 carbon atoms, and preferably from olefins of from 3 to 4 carbon atoms, and more preferably from propylene or isobutylene. The addition-polymerizable olefins employed are normally 1-olefins. The branch may be of from 1 to 4 carbon atoms, more usually of from 1 to 2 carbon atoms and preferably methyl.

The preferred alkylvinylidene isomer comprises a methyl- or ethylvinylidene isomer, more preferably the methylvinylidene isomer.

The especially preferred high molecular weight olefins used to prepare the instant copolymers are polyisobutenes which comprise at least about 20% of the more reactive methylvinylidene isomer, preferably at least 50% and more preferably at least 70%. Suitable polyisobutenes include those prepared using $BF_3$ catalysis. The preparation of such polyisobutenes in which the methylvinylidene isomer comprises a high percentage of the total composition is described in U.S. Pat. Nos. 4,152,499 and 4,605,808.

Polyisobutenes produced by conventional $AlCl_3$ catalysis when reacted with unsaturated acidic reactants, such as maleic anhydride, in the presence of a free radical initiator, produce products similar to thermal PIBSA in molecular weight and thus do not produce a copolymeric product.

Preferred are polyisobutenes having average molecular weights of about 500 to about 5000. Especially preferred are those having average molecular weights of about 900 to about 2500.

A(2) Unsaturated Acidic Reactant

The unsaturated acidic reactant used in the preparation of the instant copolymers comprises a maleic or fumaric reactant of the general formula:

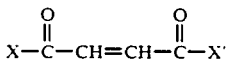

wherein X and X' are the same or different, provided that at least one of X and X' is a group that is capable of reacting to esterify alcohols, form amides or amine salts with ammonia or amines, form metal salts with reactive metals or basically reacting metal compounds and otherwise function to acylate. Typically, X and/or X' is —OH, —O—hydrocarbyl, —$OM^+$ where $M^+$ represents one equivalent of a metal, ammonium or amine cation, —$NH_2$, —Cl, —Br, and taken together X and $X^-$ can be —O— so as to form an anhydride. Preferably, X and X' are such that both carboxylic functions can enter into acylation reactions. Preferred are acidic reactants where X and X' are each independently selected from the group consisting of —OH, —Cl, —O—lower alkyl and when taken together, X and X' are —O—. Maleic anhydride is the preferred acidic reactant. Other suitable acidic reactants include electron-deficient olefins such as monophenyl maleic anhydride; monomethyl, dimethyl, monochloro, monobromo, monofluoro, dichloro and difluoro maleic anhydride; N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile, and fumaronitrile.

Preferred unsaturated acidic reactants include maleic anhydride, and maleic acid. The particularly preferred acidic reactant is maleic anhydride.

A(3) General Preparation of Copolymer

As noted above, the copolymers made by the process of the invention are prepared by reacting a reactive high molecular weight olefin and an unsaturated acidic reactant in the presence of a free radical initiator and a specific solvent, as described herein.

As discussed above, in U.S. patent application Ser. No. 251,613 it is taught that the reaction of high molecular weight olefin and unsaturated acidic reactant in the presence of a free radical initiator may be conducted neat or with a solvent, such as a saturated or aromatic hydrocarbon, a ketone or a liquid saturated aliphatic dihalogenated hydrocarbon.

It has now been found that when this reaction is carried out neat, that is, in the absence of any solvent, a significant amount of resin is formed, presumably from polymerization of the unsaturated acidic reactant.

This problem can be somewhat avoided by employing a halogenated hydrocarbon solvent, but the use of such solvents also has certain drawbacks. Halogenated hydrocarbon solvents are both expensive and environmentally undesirable. Moreover, they impede the recycling of lubricating oils because of the residual halogen content.

It has now been discovered that oligomeric copolymers of high molecular weight olefins and unsaturated acidic reactants can be prepared in improved yields by employing a solvent which comprises the reaction product of an unsaturated acidic reactant and a high molecular weight olefin. Preferably, the solvent comprises either (a) an oligomeric copolymer of an unsaturated acidic reactant and a high molecular weight olefin or (b) a monomeric adduct of an unsaturated acidic reactant and a high molecular weight olefin in at least a one-to-one mole ratio of acidic reactant to olefin. Mixtures of (a) and (b) may also be employed as the solvent.

For use as a solvent, the oligomeric copolymer of unsaturated acidic reactant and high molecular weight olefin can be conveniently obtained by retaining a portion of the oligomeric copolymer product from a previous run. Alternatively, the solvent may be a monomeric adduct of an unsaturated acidic reactant and a high molecular weight olefin in at least a 1:1 ratio of acid to olefin, which can be readily prepared via the known "thermal process" or the known "chlorination process", as described above. For use in preparing the monomeric adduct, the high molecular weight olefin may contain less than 20% of the alkylvinylidene isomer.

Preferred solvents include the oligomeric copolymer product of maleic anhydride and polyisobutene, that is, "polyPIBSA", as defined above, and the monomeric adduct of maleic anhydride and polyisobutene, namely, polyisobutenyl succinic anhydride or "PIBSA". A particularly preferred solvent is polyPIBSA.

The "thermal" PIBSA described above is well known in the art. One method of preparing thermal PIBSA is disclosed in U.S. Pat. No. 3,361,673, the disclosure of which is incorporated herein by reference for its teachings on preparing thermal PIBSA. The "chlorination process" PIBSA described above is also well known in the art. One method of preparing chlorination process PIBSA is disclosed in U.S. Pat. No. 3,172,892, the disclosure of which is incorporated herein by reference for its teachings in preparing chlorination process PIBSA.

The amount of solvent employed should be such that it can dissolve the acidic reactant and the high molecular weight olefin, in addition to the resulting copolymers. The volume ratio of solvent to high molecular weight olefin is suitably between 1:1 and 100:1, and is preferably between 1.5:1 and 4:1.

The reaction may be conducted at a temperature in the range of about 90° C. to about 210° C., and preferably from about 130° C. o about 150° C. Reaction at lower temperatures works to a point, but the reaction solution generally becomes viscous and therefore requires added heat to obtain satisfactory reaction. Although not wishing to be bound by any theory, it is believed that there is a so-called "cage-effect", wherein the free radical initiator is trapped in the solvent/reaction mixture and therefore cannot effectively initiate the polymerization reaction.

Although it has been observed that reaction may be slow or incomplete below the preferred temperature range of about 130° C. to 150° C., it is envisioned that stepping the reaction temperature up in increments from a minimum of about 90° C. could provide advantageous results. The highest temperature of these incremental temperature steps is preferably above about 140° C. when complete reaction is desired.

In general, the copolymerization process of the present invention can be initiated by any free radical initiator. Such initiators are well known in the art. However, the choice of free radical initiator may be influenced by the reaction temperature employed.

The preferred free-radical initiators are the peroxide-type polymerization initiators and the azo-type polymerization initiators. Radiation can also be used to initiate the reaction, if desired.

The peroxide-type free-radical initiator can be organic or inorganic, the organic having the general formula: $R_3OOR_3'$ where $R_3$ is any organic radical and $R_3'$ is selected from the group consisting of hydrogen and any organic radical. Both $R_3$ and $R_3'$ can be organic radicals, preferably hydrocarbon, aroyl, and acyl radicals, carrying, if desired, substituents such as halogens, etc. Preferred peroxides include di-tert-butyl peroxide, tert-butyl peroxybenzoate, and dicumyl peroxide.

Examples of other suitable peroxides, which in no way are limiting, include benzoyl peroxide; lauroyl peroxide; other tertiary butyl peroxides; 2,4-dichlorobenzoyl peroxide; tertiary butyl hydroperoxide; cumene hydroperoxide; diacetyl peroxide; acetyl hydroperoxide; diethylperoxycarbonate; tertiary butyl perbenzoate; and the like.

The azo-type compounds, typified by alpha,alpha'-azo-bisisobutyronitrile, are also well-known free-radical promoting materials. These azo compounds can be defined as those having present in the molecule group —N=N wherein the balances are satisfied by organic radicals, at least one of which is preferably attached to a tertiary carbon. Other suitable azo compounds include, but are not limited to, p-bromobenzenediazonium fluoborate; p-tolyldiazoaminobenzene; p-bromobenzenediazonium hydroxide; azomethane and phenyldiazonium halides. A suitable list of azo-type compounds can be found in U.S. Pat. No. 2,551,813, issued May 8, 1951 to Paul Pinkney.

The amount of initiator to employ, exclusive of radiation, of course, depends to a large extent on the particular initiator chose, the high molecular olefin used and the reaction conditions. The initiator must, of course, be soluble in the reaction medium. The usual concentrations of initiator are between 0.001:1 and 0.2:1 moles of initiator per mole of acidic reactant, with preferred amounts between 0.005:1 and 0.10:1.

In carrying out the process of the invention, a single free radical initiator or a mixture of free radical initiators may be employed. The initiator may also be added over time. For example, it may be desirable to add an initiator having a low decomposition temperature as the mixture is warming to reaction temperature, and then add an initiator having a higher decomposition temperature as the mixture reaches higher reaction temperatures. Alternatively, a combination of initiators could both be added prior to heating and reaction. In this case, an initiator having a high decomposition temperature would initially be inert, but would later become active as the temperature rose.

The reaction pressure should be sufficient to minimize losses of acidic reactant to the vapor phase. Pressures can therefore vary between about atmospheric and 100 psig or higher, but the preferred pressure is atmospheric.

The reaction time is usually sufficient to result in the substantially complete conversion of the acidic reactant and high molecular weight olefin to copolymer. The reaction time is suitable between one and 24 hours, with preferred reaction times between two and ten hours.

As noted above, the subject reaction is a solution-type polymerization reaction. The high molecular weight olefin, acidic reactant, solvent and initiator can be brought together in any suitable manner. The important factors are intimate contact of the high molecular weight olefin and acidic reactant in the presence of a free-radical producing material.

Although the following description shows the use of polyisobutene (PIB), maleic anhydride (MA) and polyisobutenyl succinic anhydride (PIBSA), it is intended to be merely exemplary and the disclosure is intended to apply equally well to other high molecular weight olefins, unsaturated acidic reactants and the reaction products therefrom. Moreover, the following exemplary polyPIBSA disclosure is intended to apply equally well to the copolymer reaction product of any of the unsaturated acidic reactants and high molecular weight olefins described herein.

The reaction can be run either batchwise or continuously. The reaction temperature range is about 90° C. to 210° C. and preferably about 130° C. to 150° C. The reactor temperature effects the molecular weight distribution, and this can influence the ratio of maleic anhydride to polybutene that is fed to the reactor. Theoretically the maleic anhydride charge can range from 1 to 2 moles of maleic anhydride per mole of methyl vinylidene isomer of PIB. Typically, the free radical initiator is charged at 0.1 moles initiator per 1.0 moles maleic anhydride, although this can vary. The reaction can be carried out at atmospheric pressure, although at the higher temperature range it may be desirable to pressurize the reactor slightly (i.e., 10 psig) to suppress the loss of maleic anhydride to the vapor phase. Neutral oil can be used to reduce the viscosity of the mixture, but this can be deleterious to the reaction rate and productivity of the reactor.

If the reaction is run batchwise, PIB and polyPIBSA from a previous run are charged to the reactor. Thermal process PIBSA or chlorination process PIBSA may also be used in lieu of or in addition to polyPIBSA. The ratio of PIB to polyPIBSA should be such as to assure complete solubility of maleic anhydride in the mixture at reaction conditions. If polyPIBSA is not added at a sufficient level so as to maintain total maleic anhydride solubility, the rate of reaction can be negatively affected, and the formation of resin may be likely. To maximize reactor productivity, the minimum amount of polyPIBSA that is necessary to maintain total solubility of the maleic anhydride charge should be used. The reactor is stirred and heated to the desired reaction temperature, and the maleic anhydride and free radical initiator are added at the appropriate time/times during this step. Reaction times will vary with temperature, concentration of reactants, and types of free radical initiators. Reactions performed at 140° C., for example, were nearly complete according to $^{13}C$ NMR in roughly two hours. When the reaction is complete, removal of any unreacted maleic anhydride can be accomplished by increasing the reactor temperature to 150° C. to 250° C., preferably 180° C. to 200° C., while applying sufficient vacuum. This procedure also tends to decompose any remaining free radical initiator. Another method for removal of unreacted maleic anhydride is the addition of a solvent (e.g., hexane) which solubilizes the polyPIBSA and precipitates the maleic anhydride. The mixture then is filtered to remove the maleic anhydride followed by stripping to remove the solvent.

If the reaction is run continuously, a continuous stirred tank reactor (CSTR) or series of such reactors can be used. Reaction conditions should be selected to maintain the bulk concentration of polyPIBSA at a sufficient level to maintain maleic anhydride solubility in the reactor or series of reactors. A continuous reactor is thought to be particularly advantageous for reactions carried out at the lower temperature range. As the temperature is reduced, the maleic anhydride solubility in the polyPIBSA/polybutene mixture decreases and this necessitates that the polyPIBSA concentration be increased or the maleic anhydride concentration be decreased so that total solubility of the maleic anhydride is maintained. In a batch process an increase in the initial charge of polyPIBSA can result in a decrease in reactor productivity. Likewise, decreasing the maleic anhydride charge or extending the addition of maleic anhydride over a time period can decrease reactor productivity. On the other hand, in a CSTR at steady state conditions the polyPIBSA concentration in the bulk mixture is not only constant, but it is essentially the same the product exiting the reactor. Therefore, the polyPIBSA concentration in a CSTR is at a maximum (equal to the polyPIBSA product for a single stage CSTR) when compared to a simple batch process where the all polybutene is charged at the beginning of the reaction and the polyPIBSA concentration is at a minimum.

For the continuous reactor, the temperature can range from 90° C. to 210° C. and preferably from 130° C. to 150° C. PIB, maleic anhydride, and free-radical initiator can be fed continuously at appropriate rates so as to maintain a certain level of conversion of the reactants to polyPIBSA. It is envisioned that the product stream from the reactor then is heated to a temperature in the range of 150° C. to 250° C. and preferably in the range from 180° C. to 200° C. to strip off any unreacted maleic anhydride and to decompose any remaining free-radical initiator. Vacuum can also be sued to facilitate removal of the unreacted maleic anhydride. It is envisioned that a wiped film evaporator or similar types of equipment may be suitable for this type of operation.

In one envisioned embodiment, the reaction product of an unsaturated acidic reactant and a high molecular weight, high vinylidene-containing olefin is further reacted thermally. In this embodiment, any unreacted olefin, generally the more hindered olefins, i.e., the non-vinylidene, that do not react readily with the unsaturated acidic reactant under free radical conditions are reacted with unsaturated acidic reactant under thermal conditions, i.e., at temperatures of about 180° to 280° C. These conditions are similar to those used for preparing thermal PIBSA.

The reaction solvent, as noted above, must be one which dissolves both the acidic reactant and the high molecular weight olefin. It is necessary to dissolve the acidic reactant and high molecular weight olefin so as to bring them into intimate contact in the solution polymerization reaction. It has been found that the solvent must also be one in which the resultant copolymers are soluble.

It has been found that a small amount of haze or resin, typically less than one gram per liter, is observed at the end of reaction. Accordingly, the reaction mixture is typically filtered hot to remove this haze or resin.

In general, after the reaction is deemed complete, for example, by NMR analysis, the reaction mixture is heated to decompose any residual initiator. For a di(tibutyl) peroxide initiator, this temperature is typically about 160° C.

The isolated copolymer may then be reacted with a polyamine to form a polymeric succinimide. The preparation and characterization of such polysuccinimides and their treatment with other agents to give other dispersant compositions is described herein.

A(4) Preferred Copolymers

Preferred copolymers prepared by the present process include those where an unsaturated acidic reactant, most preferably maleic anhydride, is copolymerized with a "reactive" polyisobutene, in which at least about 50 percent or more of the polyisobutene comprises the alkylvinylidene, more preferably, the methylvinylidene, isomer, to give a "polyPIBSA".

Preferred are polyPIBSAs wherein the polyisobutyl group has an average molecular weight of about 500 to about 5000, more preferably from about 950 to about 2500. Preferred are polyPIBSAs having an average degree of polymerization of about 1.1 to about 20, more preferably from about 1.5 to about 10.

B. Polysuccinimides

As noted above, polyamino polysuccinimides may be conveniently prepared by reacting a copolymer made by the present process with a polyamine. Polysuccinimides which may be prepared include monopolysuccinimides (where a polyamine component reacts with one succinic group), bis-polysuccinimides (where a polyamine component reacts with a succinic group from each of two copolymer molecules), higher succinimides (where a polyamine component reacts with a succinic group from each of more than 2 copolymer molecules) or mixtures thereof. The polysuccinimide(s) produced may depend on the charge mole ratio of polyamine to succinic groups in the copolymer molecule and the particular polyamine used. Using a charge mole ratio of polyamine to succinic groups in copolymer of about 1.0, predominately monopolysuccinimide is obtained. Charge mole ratios of polyamine to succinic group in copolymer of about 1:2 may produce predominately bis-polysuccinimide. Higher polysuccinimides may be produced if there is branching in the polyamine so that it may react with a succinic group from each of greater than 2 copolymer molecules.

The copolymers made by the present process, including preferred copolymers such as polyPIBSA, may be post-treated with a wide variety of other post-treating reagents. U.S. Pat. No. 4,234,435, the disclosure of which is incorporated herein by reference, discloses reacting succinic acylating agents with a variety of reagents to give post-treated carboxylic acid derivative compositions which are useful in lubricating oil compositions.

C. Lubricating Oil Compositions

The copolymers, polysuccinimides and modified polysuccinimides described herein are useful as detergent and dispersant additives when employed in lubricating oils. When employed in this manner, these additives are usually present in from 0.2 to 10 percent by weight to the total composition and preferably at about 0.5 to 8 percent by weight and more preferably at about 1 to about 6 percent by weight. The lubricating oil used with these additive compositions may be mineral oil or synthetic oils of lubricating viscosity and preferably suitable for use in the crankcase of an internal combustion engine. Crankcase lubricating oils ordinarily have a viscosity of about 1300 CSt 0° F. to 22.7 CSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Lubricating oil concentrates are also envisioned. These concentrates usually include from about 90 to 10 weight percent, preferably from about 90 to about 50 weight percent, of an oil of lubricating viscosity and from about 10 to 90 weight percent, preferably from about 10 to about 50 weight percent, of an additive described herein. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Other additives which may be present in the formulation include rust inhibitors, foam inhibitors, corrosion inhibitors, metal deactivators, pour point depressants, antioxidants, and a variety of other well-known additives.

It is also contemplated that the additives described herein may be employed as dispersants and detergents in hydraulic fluids, marine crankcase lubricants and the like. When so employed, the additive is added at from about 0.1 to 10 percent by weight to the oil. Preferably, at from 0.5 to 8 weight percent.

D. Fuel Compositions

When used in fuels, the proper concentration of the additive necessary in order to achieve the desired detergency is dependent upon a variety of factors including the type of fuel used, the presence of other detergents or dispersants or other additives, etc. Generally, however, the range of concentration of the additive in the base fuel is 10 to 10,000 weight parts per million, preferably from 30 to 5000 parts per million of the additive per part of base fuel. If other detergents are present, a lesser amount of the additive may be used. The additives described herein may be formulated as a fuel concentrate, using an inert stable oleophilic organic solvent boiling in the range of about 150° to 400° F. Preferably, an aliphatic or an aromatic hydrocarbon solvent is used, such a benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the fuel additive. In the fuel concentrate, the amount of the additive will be ordinarily at least 5 percent by weight and generally not exceed 70 percent by weight, preferably from 5 to 50 and more preferably from 10 to 25 weight percent.

The following examples are offered to specifically illustrate this invention. These examples and illustrations are not to be construed in any way limiting the scope of this invention.

EXAMPLES

Example 1 (Comparative)

Preparation of Polyisobutyl-24 PolyPIBSA

To a 12-liter, 3-neck flask equipped with an overhead stirrer, thermometer, condenser, and heating mantle under nitrogen atmosphere was added 5,000 grams (5.265 mole) of polyisobutene of about 950 molecular weight having the trade name ULTRAVIS-10 obtained from BP Chemicals wherein the methylvinylidene isomer comprised about 70% of the total composition, 1547.1 grams (15.79 mole) maleic anhydride, and 2,500 ml chloroform. The mixture was heated to reflux, and to this was added 67.21 grams (0.41 mole) 22'-azobis (2-methyl-propionitrite) ("AIBN"). The mixture was refluxed for two hours at which time an additional 67.21 grams of AIBN was added. This was followed by another two hours of reflux and a third charge (66.58 grams) of AIBN. A total of 201 grams (1.2 mole) of AIBN Was added. The reaction mixture was refluxed a total of 20 hours, and then allowed to cool. Two layers formed. The lower phase which contained mostly chloroform and unreacted maleic anhydride was discarded. The upper layer which contained mainly product and unreacted polyisobutene was separated. Solvent and maleic anhydride were removed in vacuo. A total of 4,360 grams of product having a saponification number of 40.4 was recovered.

Example 2 (Comparative)

Preparation of Polyisobutyl-24 PolyPIBSA

To a 1-liter 3-neck flask equipped with a thermometer, overhead stirrer, nitrogen inlet and water condenser, was added 165.02 grams (0.174 mole) polyisobutylene (ULTRAVIS-10 from BP Chemicals) and 105 ml dichloroethane, then 16.4 grams (0.167 mole) maleic anhydride were added. The resulting mixture was heated to about 45° C., and 3.3 grams (0.017 mole) tert-butylperbenzoate was added. The resulting mixture was heated to reflux (83° C.). The reaction mixture was heated (with stirring) for a total of 30 hours. The reaction mixture was allowed to cool. The solvent was removed in vacuo. Unreacted maleic anhydride was removed by heating the residue to 150° C. at 0.1 mm Hg vacuum. A total of 176.0 grams product was obtained, which had an average molecular weight of about 5000. The conversion was about 60% . The saponification number was 73.3.

Examples 3 to 15 and Examples 1C to 5C (Comparative)

Table I tabulates additional preparations following the basic synthetic procedure outlined in Examples 1 and 2. Table I lists the reactants, reaction temperature, time and solvent, and free radical initiator used.

Example 12 was prepared using polyisobutene of about 1300 molecular weight having the trade name ULTRAVIS-30 obtained from BP chemicals wherein the methylvinylidene isomer comprised about 70% of the total composition.

Comparison Examples 1C to 5C were prepared using a polyisobutylene of about 950 molecular weight prepared with $AlCl_3$ catalysis having the trade name Parapol 950 obtained from Exxon Chemical.

TABLE I

| Product of Example No. | Polybutene (g) | Maleic Anhydride (g) | Solvent (ml) | Initiator* (g) | Temp °C. | Time Hrs. |
|---|---|---|---|---|---|---|
| 2 | Ultravis-10 (165.09) | 16.4 | Dichloroethane (105) | TBPB (3.3) | 83 | 30 |
| 3 | Ultravis-10 (384.6) | 119 | Toluene (250) | AIBN (15.5) | 110 | 6 |
| 4 | Ultravis-10 (330) | 32.3 | Chlorobenzene (210) | DTBP (5.8) | 138 | 30 |
| 5 | Ultravis-10 (5000) | 1547 | Dichloroethane (2500) | AIBN (200) | 83 | 13 |
| 6 | Ultravis-10 (384.6) | 119 | Chloroform (250) | AIBN (15.5) | 74 | 24 |
| 7 | Ultravis-10 (384.6) | 119 | Methylene Chloride (250) | AIBN (15.5) | 40 | 94 |
| 8 | Ultravis-10 (330) | 32.3 | Toluene (210) | DTBP (5.8) | 110 | 30 |
| 9 | Ultravis-10 (330) | 32.3 | Xylene (210) | DTBP (5.8) | 144 | 39 |
| 10 | Ultravis-10 (330) | 32.3 | Xylene (210) | DTBP (5.8) | 114 | 4 |
| 11 | Ultravis-10 (330) | 32.3 | Toluene (210) | DTBP (5.8) | 110 | 4 |
| 12 | Ultravis-30 (217.1) | 16.4 | Dichloroethane (105) | TBPB (3.3) | 83–184 | 26 |
| 13 | Ultravis-10 (3350) | 328.3 | Chlorobenzene (1600) | DTBP (42.6) | 138 | 28 |
| 14 | Ultravis-10 (5000) | 515.8 | Chloroform (3000) | TBPB (102.8) | 72 | 54 |
| 15 | Ultravis-10 (10,000) | 1031 | Chloroform (6000) | TBPB (205.6) | 72 then 140 | 48 2 |
| 1C | Parapol 950 (384.6) | 119 | Toluene (250) | AIBN (15.5) | 110 | 6 |
| 2C | Parapol 950 (76.4) | 23.8 | Dichloroethane (50) | AIBN (2.33) | 83 | 4 |
| 3C | Parapol 950 (330) | 32.3 | Toluene (210) | DTBP (5.8) | 110 | 30 |
| 4C | Parapol 950 (330) | 32.3 | Xylene (210) | DTBP (5.8) | 114 | 30 |
| 5C | Parapol 950 (330) | 32.3 | Chlorobenzene (210) | DTBP (5.8) | 138 | 30 |

*AIBN = 2,2-azobis (2-methyl-propionitrite); DTBP = ditertbutyl peroxide; TBPB = tertbutyl peroxybenzoate

**Molecular weight 1300

EXAMPLE 16

A 500-ml, 3-necked flask was charged with 100 g of a polyPIBSA/polybutene mixture (prepared according to the method of Example 5) which comprised about 38 weight percent polyPIBSA and about 62 weight percent (0.0653 mol) unreacted polyisobutene (of which about 68 weight percent (0.0444 mol) comprised the methylvinylidene isomer). The mixture was heated to 70° C. Then, 8 g (0.0816 mol) maleic anhydride and 1.7 g (0.0116 mol) di-tert-butyl peroxide were added to the mixture. The mixture was stirred and heated to 150° C. for 5 hours. After allowing the mixture to cool, 150 ml hexane was added to precipitate unreacted maleic anhydride which was then removed by filtration. The hexane was removed by stripping for 4 hours at 36 mm Hg (abs) at 90° C. The filtered product had an unreacted maleic anhydride content of 0.08 weight percent, as determined by gas chromatography. The saponification number of the final product was determined to be 84 mg KOH/g sample. The amount of unreacted polybutene was determined to be 28.2% by column chromatography.

Example 17A

A 22-liter, 3-necked flask was charged with 3752 g (3.95 mol) of polyisobutene (BP Ultravis 10) and 2800 g of a polyPIBSA/polyisobutene mixture (prepared according to Example 13) which comprised about 57 weight percent polyPIBSA and about 43 weight percent (1.27 mol) unreacted polyisobutene. The mixture was heated to 91° C.; then 14 g (0.143 mol) maleic anhydride and 2.7 g (0.0185 mol) di-tert-butyl peroxide (DTBP) were added. A slight exotherm was noticed where the temperature increased to 147° C. The mixture was stirred and heated at 140° C. for one hour. After standing at room temperature overnight, the mixture was heated to 140° C. and 378 g (3.86 mol) maleic anhydride and 56.7 g (0.388 mol) of DTBP were added. The mixture was stirred and heated at 140° C. for 6.5 hours. The mixture was allowed to cool to ambient temperature overnight. The mixture was heated to 80° C. and vacuum was applied at 28 inches Hg (vac); the temperature was increased to 200° C. The mixture was stripped at 200° C. and 28 inches Hg (vac) for 2 hours to remove any unreacted maleic anhydride. Analysis of the final product by proton NMR showed that a significant amount of the polybutene methylvinylidene isomer had disappeared along with the maleic anhydride.

Example 17B

A 22-liter, 3-necked flask was charged with 8040 g (8.46 mol) polyisobutene (BP Ultravis 10) and 6000 g of a polyPIBSA/polybutene mixture prepared according to Example 17A. The mixture was heated to 109° C., then 840 g (8.57 mol) maleic anhydride and 126 g (0.863 mol) DTBP were added. The resulting mixture was stirred and heated at 140° C. for 5.25 hours. The mixture was cooled to ambient temperature. The mixture was then heated to 128° C. with stirring and an additional 153 g (1.561 mol) maleic anhydride and 23 g (0.158 mol) DTBP were added. The mixture was stirred and heated at 140° C. for 3.5 hours and then an additional 153 g (1.561 mol) maleic anhydride and 11.8 g (0.0808 mol) DTBP were added. The mixture was stirred and heated at 140° C. for an additional 3.67 hours. The mixture was cooled to ambient temperature. The mixture was then stirred and heated at 186° C. for one hour while vacuum was applied to strip the unreacted maleic anhydride from the product. The product had a saponification number of 85.8 mg KOH/g. Inspection of the proton NMR spectrum of the final product indicated that the polybutene methyl vinylidene isomer was significantly depleted and that the maleic anhydride was totally consumed.

Example 18

Preparation of PolyPIBSA TETA Polysuccinimide with a Low Degree of Polymerization To a 5-liter flask equipped with a heating mantle, overhead stirrer and Dean Stark trap under nitrogen sweep, was added 1000 g polyPIBSA prepared according to Example 17B (saponification number 85.8, molecular weight about 2500) and 999 g Chevron 100NR diluent oil. The mixture was heated to 60° C.; then 75.78 g triethylene tetraamine (TETA) was added. The mixture was heated to 160° C. and kept at temperature for 4 hours. A total of 7.0 ml water was recovered from the Dean Stark trap The reaction mixture was then maintained at 160° C. under vacuum for 2 hours. The reaction mixture was allowed to cool. Obtained was 2018.2 g of product having % N=1.35.

Example 19

Preparation of PolyPIBSA HPA Polysuccinimide With a Low Degree of Polymerization To a 5-liter flask equipped with a heating mantle, overhead stirrer and Dean Stark trap (under nitrogen sweep) was added 1000 g polyPIBSA prepared according to Example 17B (saponification number 85.8 molecular weight 2500) and 932 Chevron 100NR diluent oil. The mixture was heated to 60° C.; to this was added 142.45 g heavy polyamine ("HPA") No. X obtained from Union Carbide Corporation. The mixture became very thick. The reaction mixture was heated to 165° C. and maintained at that temperature for 4 hours; the mixture became less viscous. Then the reaction mixture was heated at 165° C. under vacuum for 2 hours. The mixture was allowed to cool. Obtained was the above-identified product having % N=2.23.

Example 20 (Comparative)

An experiment was performed in a manner similar to Examples 17A and 17B, but in the absence of any added oligomeric copolymer solvent. The resulting mixture, upon heating, formed a significant amount of maleic anhydride (MA) resin, as indicated by total disappearance of the MA peak in the proton NMR, while still leaving a large amount of methyl vinylidene protons. Moreover, MA resin formation was evidenced by the product being stuck to the reactor walls and the formation of tar.

Example 21

Proton NMR Analysis of Reaction of Polyisobutene with MA

The reaction of PIB with MA can be monitored by proton NMR. The MA peak in deuterochloroform is located at 7.07 ppm and the methyl vinylidene olefin hydrogens are at 4.61 and 4.87 ppm. Disappearance of these peaks, especially the PIB vinylidene peaks, indicates copolymerization with the MA. IR can also be used to confirm that copolymerization is occurring. Generally, the reaction is run until the MA olefin peak disappears and the methyl vinylidene peaks have significantly decreased.

Example 22

Saponification Number of PIBSA and PolyPIBSA

Approximately one gram of sample is weighed and dissolved in 30 ml xylene in a 250-ml Erlenmeyer flask at room temperature. Unless otherwise noted, the polyPIBSA product samples were filtered at about reaction temperature to remove any MA hydrolysis product (i.e., fumaric acid) and any poly MA resin.

Twenty-five ml of KOH/methanol is added to the xylene solution. A reflux condenser is attached and the mixture is heated to reflux using a hotplate/stirrer and held at reflux for 20 minutes. A ceramic spacer is placed beneath the flask, and 30 ml of isopropyl alcohol is added through the condenser. The sample is then cooled to about room temperature and back titrated with 0.5 Normal HCl, using a Metrohm 670 auto titrator and a Dosimat 665 pump system.

Comparisons with blanks provide the saponification number (SAP number), which is mg of KOH/gm of sample.

Examples 23–25

Examples 23–25 were carried out following the general procedure of Examples 16, 17A and 17B. The results are shown in Table II.

In Example 24, proton NMR showed a significant consumption of polyisobutene methyl vinylidene isomer and maleic anhydride. In Example 25, the maleic anhydride and free radical initiator were added by slugs.

Example 26

A reaction mixture containing 350 grams of a 45 weight percent polyPIBSA and 55 weight percent unreacted polyisobutene mixture having a SAP Number of 34 was combined with 150 grams BP ULTRAVIS 30, a high vinylidene polyisobutene having an average molecular weight of about 1300 and 176 grams of a Chevron 100 neutral lubricating oil. The mixture was heated to 50° C. Twenty-two (22) grams of maleic anhydride and 5 grams of t-butylperoxy-2-ethyl hexanoate (t-butyl peroctoate) were added. The reaction temperature was raised to 90° C. and held at this temperature for 4 hours. A product with a SAP Number of 26 was produced. Proton NMR indicated a very slow reaction rate.

Example 27

A reaction mixture containing 500 grams of a 45 weight percent polyPIBSA and 55 weight percent unreacted polyisobutene mixture having a SAP Number of 34 was combined with 214 grams BP ULTRAVIS 30, a high vinylidene polyisobutene having an average molecular weight of about 1300. The mixture was heated to 110° C. and 31.4 grams of maleic anhydride was added. Every 15 minutes starting from the MA addition time, 6.53 grams of 100 neutral oil and 0.73 grams of t-butylperoxy-2-ethyl hexanoate (t-butyl peroctoate) were added. Additions were continued for the first 2 hours and 30 minutes. Thereafter the reaction was held at 110° C. for 5.5 hours. This produced a product which had a SAP Number of 31. Proton NMR showed a slow reaction rate.

Example 28

A reaction mixture containing 464 grams of a 45 weight percent polyPIBSA and 55 weight percent unreacted polyisobutene mixture having a SAP Number of 34 was combined with 316 grams BP ULTRAVIS 30, a high vinylidene polyisobutene having an average molecular weight of about 1300. The mixture was heated to 120° C. and 31.2 grams of maleic anhydride and 5.85 grams of t-butylperoxy-2-ethyl hexanoate (t-butyl peroctoate) were added. The reaction temperature was raised to and held at 120° C. for 6 hours. A product with a SAP Number of 33 was produced.

Example 29

A reaction mixture containing 259 grams of a 45 weight percent polyPIBSA and 55 weight percent unreacted polyisobutene mixture having a SAP number of 34 was combined with 177 grams BP ULTRAVIS 30, a high vinylidene polyisobutene having an average molecular weight of about 1300. The mixture was heated to 130° C. and 12.6 grams of maleic anhydride and 3.32 grams of di-t-butylperoxide were added. The reaction temperature was held at 130° C. for 5 hours. Then 5.1 grams of maleic anhydride and 0.7 grams of di-t-butylperoxide were added. The temperature was raised to 140° C. and then held these for 4.5 hours. The product had a SAP Number of 41. Proton NMR showed a significant reduction in polyisobutene methyl vinylidene isomer.

Example 30

A reaction mixture containing 896 grams of polyPIBSA containing some unreacted polybutene was combined with 1883 grams BP ULTRAVIS 30. The mixture was heated to 140° C. and 142 grams of maleic anhydride and 21.2 grams of di-t-butylperoxide were added. The reaction temperature was raised and held at 140° C. for 4 hours and then heated to 200° C. for 2 hours. The product had a SAP Number of 49.

Example 31 (Comparative)

A reactor containing 721 grams BP ULTRAVIS 30 was heated to 140° C. and 38.8 grams of maleic anhydride and 8.2 grams of di-t-butylperoxide were added. This reaction was done in the absence of added polyPIBSA solvent. The reaction temperature was held at 140° C. for 7 hours. An abundance of tarry resin, believed to be derived from the maleic anhydride was evident. The mixture was filtered hot. The product had a SAP number of 17 after the resin was filtered out. The percent actives was 37% .

Example 32

This reaction shows that after the copolymer is formed, unreacted PIB can be reacted with maleic anhydride to form thermal PIBSA.

PolyPIBSA prepared in a manner similar to Example 17B having a SAP Number of 86 was charged to a reactor and heated to 204° C. A molar equivalent of MA (43.3 g), relative to unreacted non-vinylidene polybutene, of MA was added and the mixture heated to 232° C. and held at this temperature for 4 hours. The temperature was reduced to 210° C. and the pressure was reduced to 28 inches of mercury. The reduced pressure and temperature was maintained for one hour. Then the mixture was filtered. The product had a SAP Number of 88. The results of Examples 26–32 are shown in Table II.

TABLE II

| Example | PIB MW | PIB Mole | MA Mole | Initiator Type | Init. Mole | PIB Grams | PolyPIBSA Grams | Wt % PIB in Rx Mixture | Rx Temp °C. | Rx time Minutes | SAP Number | Wt % Actives |
|---|---|---|---|---|---|---|---|---|---|---|---|---|
| 23 | 950 | 0.00 | 0.08 | Di-t-Butyl Peroxide | 0.12 | 0.0 | 100 | 0.0 | 150 | 300 | 90 | 71.8 |
| 24 | 950 | 3.95 | 4.00 | Di-t-Butyl Peroxide | 0.40 | 3752.0 | 2800.0 | 57.3 | 140 | 400 | — | — |
| 25 | 950 | 8.46 | 8.57 | Di-t-Butyl Peroxide | 0.86 | 8040.0 | 6000.0 | 53.5 | 140 | 620 | 76 | 77.2 |
| 26[a] | 1300 | 0.12 | 0.23 | t-Butyl Peroctoate | 0.02 | 150.0 | 350.0 | 22.2 | 90 | 240 | 26 | — |
| 27[b] | 1300 | 0.17 | 0.32 | t-Butyl Peroctoate | 0.03 | 214.5 | 500.0 | 27.5 | 110 | 330 | 31 | — |
| 28 | 1300 | 0.24 | 0.32 | Di-t-Butyl Peroxide | 0.04 | 315.8 | 463.8 | 40.5 | 120 | 240 | 33 | — |
| 29 | 1300 | 0.14 | 0.13 | Di-t-Butyl Peroxide | 0.03 | 176.9 | 259.0 | 40.6 | 130 | 450 | 41 | — |
| 30 | 1300 | 1.45 | 1.45 | Di-t-Butyl Peroxide | 0.15 | 1883.0 | 896.0 | 70.3 | 140 | 240 | 49 | 60.4 |
| 31 | 1300 | 0.55 | 0.40 | Di-t-Butyl Peroxide | 0.06 | 721.0 | 0.0 | 100.0 | 140 | 420 | 17 | 32.6 |
| 32 | 950 | 0.00 | 0.44 | None | 0.00 | 0.0 | 700.0 | 0.0 | 232 | 240 | 88 | 78.0 |

[a]The reaction mixture contained 176 grams of neutral lubrication oil (26 wt. % in reaction mixture).
[b]The reaction mixture contained 65.25 grams of neutral lubrication oil (8.4 wt. % in reaction mixture).

What is claimed is:

1. A process for preparing an oligomeric copolymer of an unsaturated acidic reactant and a high molecular weight olefin having a sufficient number of carbon atoms such that the resulting copolymer is soluble in lubricating oil and wherein at least 20 weight percent of the total olefin comprises an alkylvinylidene isomer, which process comprises reacting the high molecular weight olefin with the unsaturated acidic reactant in the presence of a free radical initiator and a solvent which comprises the reaction product of an unsaturated acidic reactant and a high molecular weight olefin having about 32 carbon atoms or greater.

2. The process according to claim 1, wherein the unsaturated acidic reactant employed to produce either the copolymer product or the solvent is of the formula:

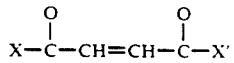

wherein X and X' are each independently selected from the group consisting of —OH, —Cl, —O—lower alkyl of 1 to 6 carbon atoms and when taken together, X and X' are —O—.

3. The process according to claim 1, wherein at least 50 percent of the total olefin employed to produce the copolymer product comprises an alkylvinylidene isomer.

4. The process according to claim 1, wherein the high molecular weight olefin employed to produce either the copolymer product or the solvent has an average molecular weight of about 500 to about 5000.

5. The process according to claim 1, wherein the high molecular weight olefin employed to produce either the copolymer product or the solvent is polyisobutene.

6. The process according to claim 1, wherein the oligomeric copolymer produced has an average degree of polymerization of about 1.5 to about 10.

7. The process according to claim 1, wherein the acidic reactant employed to produce the copolymer product is maleic anhydride and the alkylvinylidene isomer employed to produce the copolymer product is methylvinylidene.

8. The process according to claim 1, wherein the solvent comprises the reaction product of maleic anhydride and polyisobutene.

9. The process according to claim 8, wherein the solvent comprises thermal PIBSA or chlorination process PIBSA.

10. The process according to claim 1, wherein the solvent comprises the oligomeric copolymer product of said process.

11. The process according to claim 10, wherein the solvent comprises polyPIBSA.

12. The process according to claim 1, wherein the solvent comprises either (a) an oligomeric copolymer of an unsaturated acidic reactant and a high molecular weight olefin having about 32 carbon atoms or greater, or (b) a monomeric adduct of an unsaturated acidic reactant and a high molecular weight olefin having about 32 carbon atoms or greater in at least a one to one mole ratio of acidic reactant to olefin; or a mixture thereof.

* * * * *